US007469962B2

(12) United States Patent
Paulin

(10) Patent No.: US 7,469,962 B2
(45) Date of Patent: Dec. 30, 2008

(54) DISPOSABLE CHAIR COVER

(76) Inventor: Victoria Paulin, 6293 Medres Cir., Boynton Beach, FL (US) 33437

( * ) Notice: Subject to any disclaimer, the term of this patent is extended or adjusted under 35 U.S.C. 154(b) by 0 days.

(21) Appl. No.: 11/104,006

(22) Filed: Apr. 12, 2005

(65) Prior Publication Data

US 2005/0236876 A1 Oct. 27, 2005

Related U.S. Application Data

(63) Continuation-in-part of application No. 10/816,530, filed on Apr. 1, 2004, now abandoned.

(51) Int. Cl.
*A47C 31/00* (2006.01)

(52) U.S. Cl. ..... 297/229; 297/219.1

(58) Field of Classification Search ..... 297/219.1, 297/228.1, 229, 225, 228, 440.11
See application file for complete search history.

(56) References Cited

U.S. PATENT DOCUMENTS

| | | | | |
|---|---|---|---|---|
| 1,820,104 | A * | 8/1931 | Whaley | 297/224 |
| 2,349,193 | A * | 5/1944 | Pass | 297/225 |
| 3,371,957 | A | 3/1968 | Cook | |
| 4,693,511 | A * | 9/1987 | Seltzer et al. | 297/228.1 |
| 4,697,847 | A | 10/1987 | Herschlag | |
| D321,805 | S | 11/1991 | Piciullo | |
| 5,121,938 | A * | 6/1992 | Gross et al. | 280/304.1 |
| 5,540,480 | A * | 7/1996 | Christa | 297/219.1 |
| 5,690,380 | A * | 11/1997 | Waters | 297/225 |
| 6,001,460 | A | 12/1999 | Morman et al. | |
| 6,079,778 | A * | 6/2000 | Lindberg | 297/223 |
| 6,096,668 | A | 8/2000 | Abuto et al. | |
| 6,207,237 | B1 | 3/2001 | Haffner | |
| 6,309,017 | B1 * | 10/2001 | Middleton | 297/219.1 |
| 6,354,661 | B1 * | 3/2002 | Moss | 297/229 |
| 6,428,098 | B1 | 8/2002 | Allbaugh | |
| 6,447,059 | B1 * | 9/2002 | Jackson et al. | 297/228.12 |
| D469,999 | S | 2/2003 | Christoffersen | |
| 6,532,595 | B1 | 3/2003 | Holmes | |
| 6,655,734 | B2 | 12/2003 | Hunter et al. | |
| 7,011,365 | B2 * | 3/2006 | Kerfoot et al. | 297/219.12 |
| 7,011,367 | B2 * | 3/2006 | Riley | 297/228.1 |
| 2003/0227200 | A1 | 12/2003 | Lopez | |
| 2004/0130193 | A1 | 7/2004 | Haller | |
| 2004/0262964 | A1 * | 12/2004 | Ryan | 297/219.1 |
| 2005/0151391 | A1 * | 7/2005 | Bryd | 296/136.1 |

FOREIGN PATENT DOCUMENTS

| | | | |
|---|---|---|---|
| GB | 2032268 | A * | 5/1980 |

* cited by examiner

*Primary Examiner*—Sarah B. McPartlin
(74) *Attorney, Agent, or Firm*—Kevin P. Crosby; Daniel C. Crilly; Brinkley, Morgan et al.

(57) ABSTRACT

Form-fitting chair covers preferably formed from a disposable, non-woven fabric are disclosed. The covers are preformed in a variety of shapes to fit a variety of chair types. Provisions may be made for adjusting the chair cover to fit to a particularly sized chair. The covers may be made from one or more pieces of non-woven material and pieced together by sewing or any other suitable fastening arrangement.

3 Claims, 9 Drawing Sheets

DISPOSABLE CHAIR COVER

This application is a continuation in part of application Ser. No. 10/816,530 filed Apr. 1, 2004 now abandoned.

BACKGROUND OF THE INVENTION

1. Field of the Invention

This invention relates to the field of furniture coverings and, more particularly, pertains to sanitary and decorative chair covers.

2. Description of the Background Art

Chair covers are often used to cover chairs to protect them from dust, dirt, spills and the like. Also, it is common to cover chairs with a cover that improves the aesthetic appearance of the chair. Chair covers are widely used in the hospitality industry such as at banquets, entertainment and special events. Chair covers are commonly constructed of cloth fabric material which can be removed from its position about the chair and laundered. The expense in providing the cloth chair cover initially, and of transporting, laundering and storing such covers, has created a prohibitively expensive pricing for such covers such that many who would prefer to use chair covers at their special events do not. As a result, a significant demand goes unmet in the industry.

Nevertheless, the use of covers for commercial seating is highly desirable, as commercial seating being used by a great many people as time passes become worn and unsanitary. Therefore, there is a need to employ seat coverings for commercial seating but which do not suffer from the economic limitations referenced above.

The need exists, therefore, to provide an affordable chair cover to limit users' contact with commercially used chairs to reduce wear and tear and the spread of illness and disease that may result from contact with the contaminated surfaces of the chairs.

It is, therefore, a primary object of my invention to provide a sanitary chair cover for commercial seating, such as banquet and/or folding chairs and the like, which is made from an inexpensive, single-use material.

It is also an object of this invention to provide covers for commercial chairs which eliminate the need and expense of cleaning the chairs due to the fact that the covers provide a barrier to the transmission of contaminants between the seat and the users of the seat.

It is a further object of my invention to provide a seat cover that may be easily replaced each time the chair is used for a different event.

SUMMARY OF THE INVENTION

To address these and other needs, the present invention provides a disposable sanitary seat cover fabricated from inexpensive, non-woven, disposable fabric readily adapted for a wide variety of chairs, such as, for example but not by way of limitation, banquet chairs and/or folding chairs.

The present invention also provides methods for adjusting the dimensions and contours of the pre-manufactured covers of this invention so that the covers fit over the chairs snugly and neatly.

The covers are made of a non-woven fabric which is inexpensive and may, therefore, be discarded after use.

DETAILED DESCRIPTION

Figure 1:
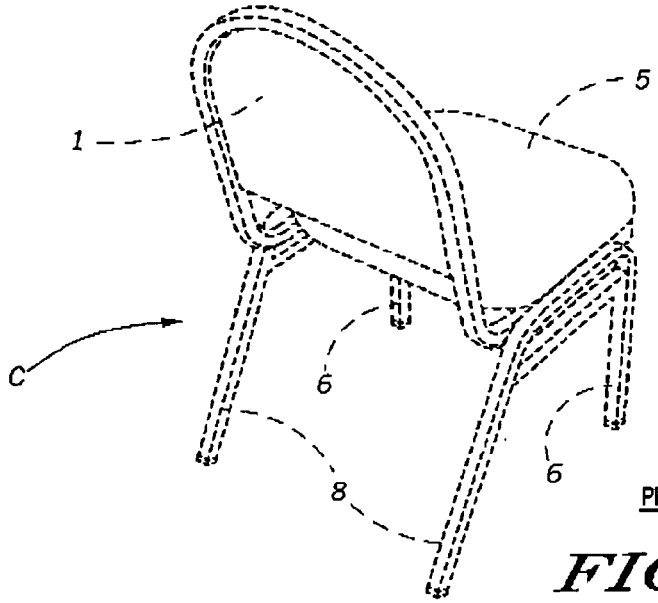
PRIOR ART FIG. 1
FIG. 1 shows a typical prior art banquet chair which a first embodiment of the cover of the instant invention is meant to partially encapsulate.

Referring now to the drawings, FIG. 1 shows a conventional banquet-type chair denoted by the letter "C" of the type commonly used at social functions such as weddings, birthday parties, concerts, etc. The type of chair shown here is merely to provide an example of one type of chair in connection with which the instant invention can be used. Any other chair, whether of the foldable or non-foldable variety, which is adaptable to receive a non-woven, disposable chair cover, is contemplated to be within the field of use of the instant invention.

Figure 2:
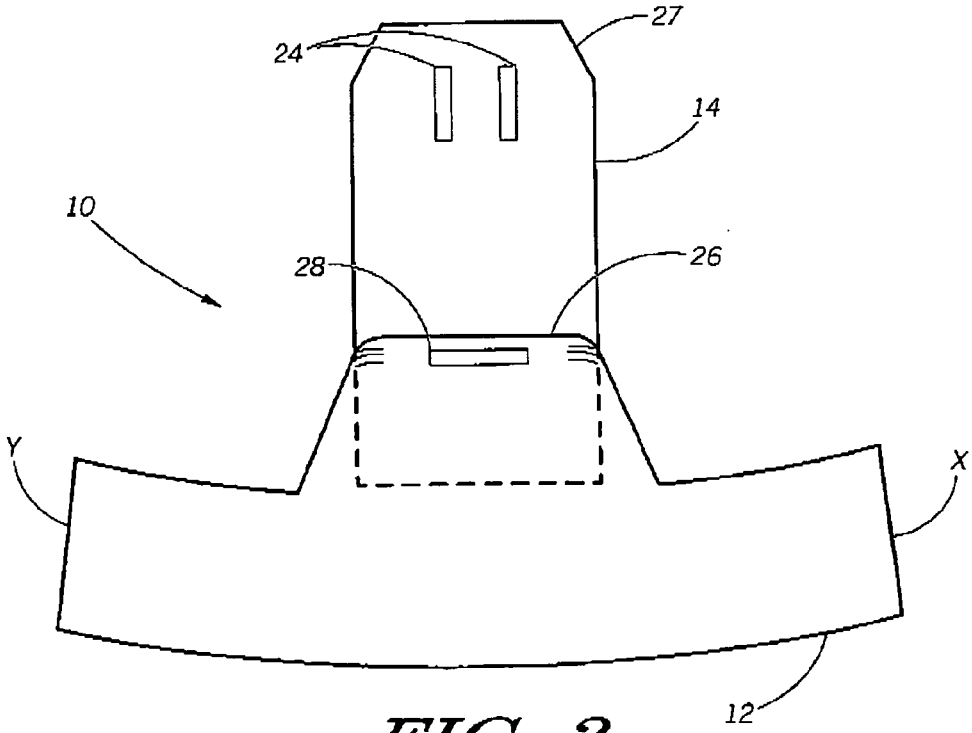
FIG. 2 is a plan view of two sections of non-woven fabric which are adapted to be sewn together or otherwise attached to form the first embodiment of the instant invention.
Figure 3:
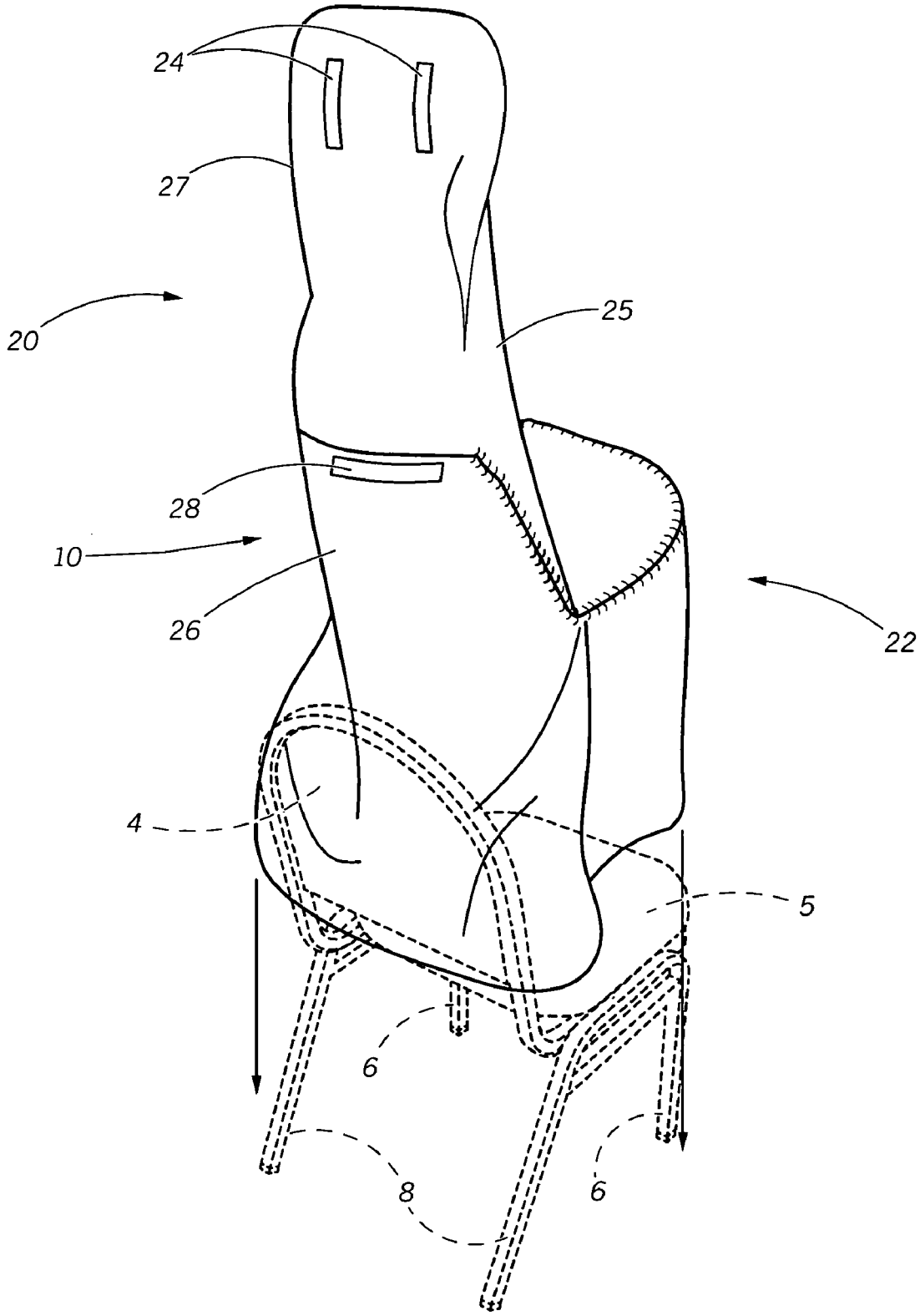
FIGS. 3 through 5 are rear perspective views showing an assembled chair cover of the first embodiment of instant invention being placed about a chair.

FIG. 2 shows a typical pattern layout for a first embodiment of the non-woven fabric chair cover of the instant invention prior to the fabric being sewn or otherwise attached together to form a form-fitting chair cover 10. It will be appreciated that the shape of the fabric patterns will vary depending upon the particular chair to be covered. The material may be formed of two panels 12, 14, which are to be sewn together in such a way as to form the cover shown in FIGS. 3 though 9. The panels 12, 14 may be attached though sewing/stitching, ultrasonic welding, adhesive, hook and loop fastener, snaps, buttons, or any other suitable connection structure. The cover 10, as seen in FIGS. 3 though 9, forms generally a back portion 20 adapted to at least partially envelope seat back section, as well as a lower cover section 22 adapted to envelope seat portion 5 and front and rear legs 6, 8 of chair "C". In this way, a user of the chair will not though ordinary use be able to come into contact with chair "C" while cover 10 is in place.

FIGS. 3 though 5 show the chair cover after being assembled.

An additional feature may (but need not necessarily) be employed to permit adjustment of the height of cover 10 relative to chair "C". In connection with this additional feature, back portion 20 of cover 10 includes a front panel 25, a rear panel 26 and a flap 27 which is connected to lower cover section 22 and which is adapted to be folded over the top of seat back 4 and laid against rear panel 26 to form a natural height adjustment mechanism for cover 10. Flap 27 may be held in place against rear panel 26 by any suitable means, such as the hook and loop fastener strips 24, 28 attached to flap 27 and rear panel 26, respectively.

It is to be appreciated that the adjustability feature embodied in flap 27 and fasteners 24, 28 constitutes an option which is not necessary for the realization of the benefits of the instant invention, which is simply a non-woven, form fitting chair cover.

Figure 4:
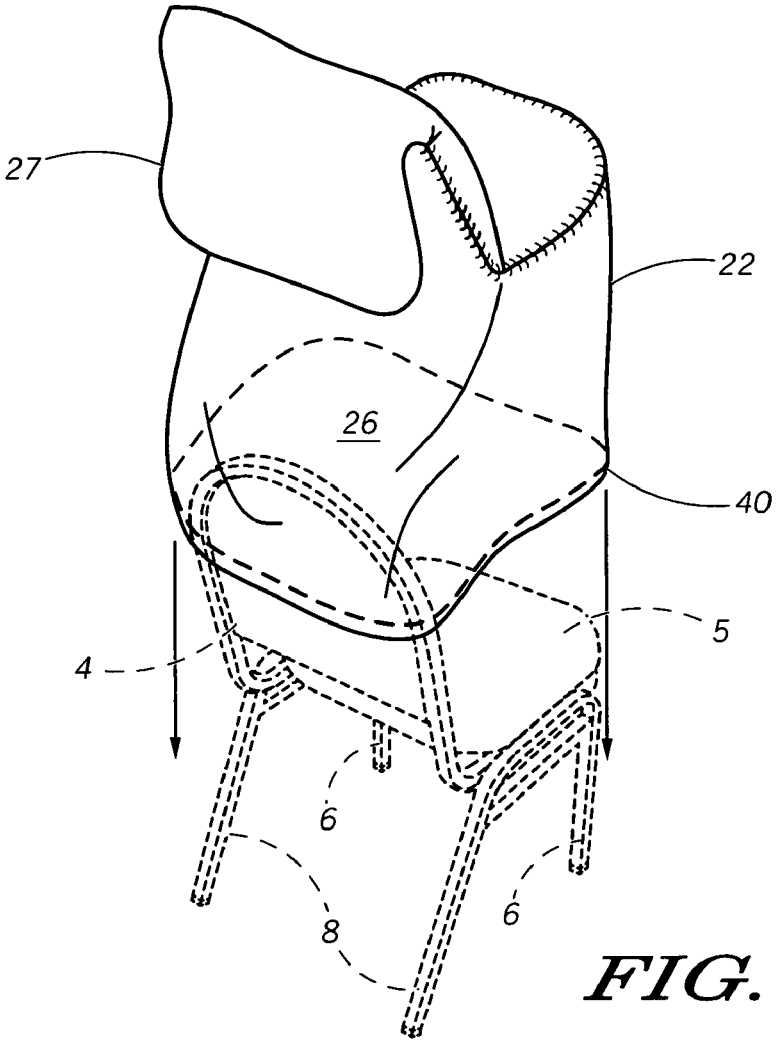
Figure 5:
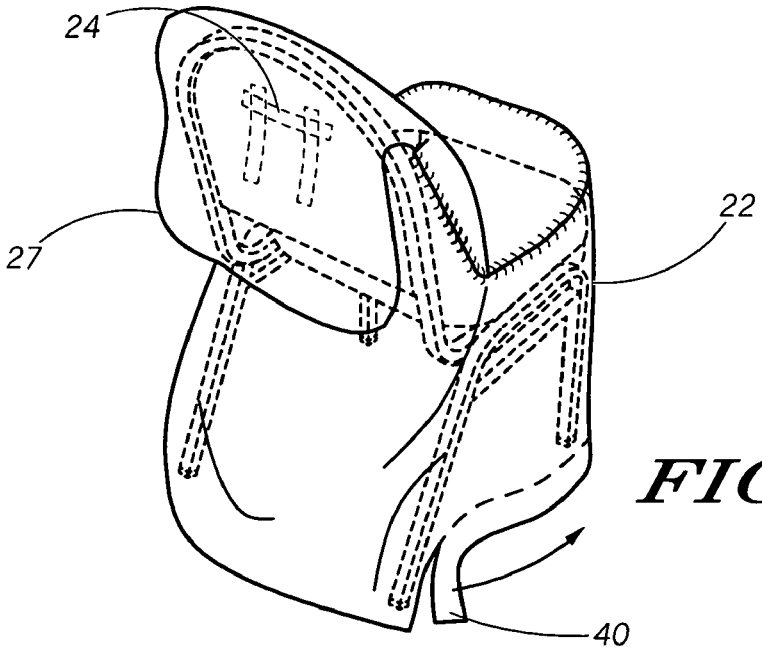

FIGS. 4 and 5 show an additional adjustment feature which may or may not be employed with the instant invention. The additional feature is comprised of a tear away strip 44 attached to lower pocket 22 by a perforated or other frangible connection. Strip 40 may be removed from cover 10 in the event that the legs 6, 8 are shorter than the height of lower pocket 22. In this way, cover 10 will hang down to the bottom of legs 6, 8 and not be too long and cause the material of cover 10 to buckle, which would be a potential tripping hazard as well as unsightly.

Figure 6:
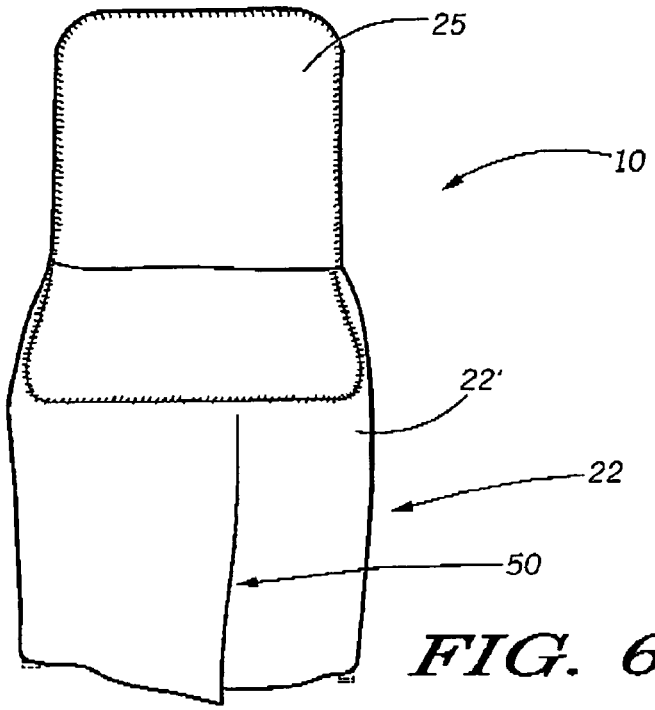
FIG. 6 is a front elevational view of the first embodiment of the instant invention placed over a banquet chair.
Figure 7:
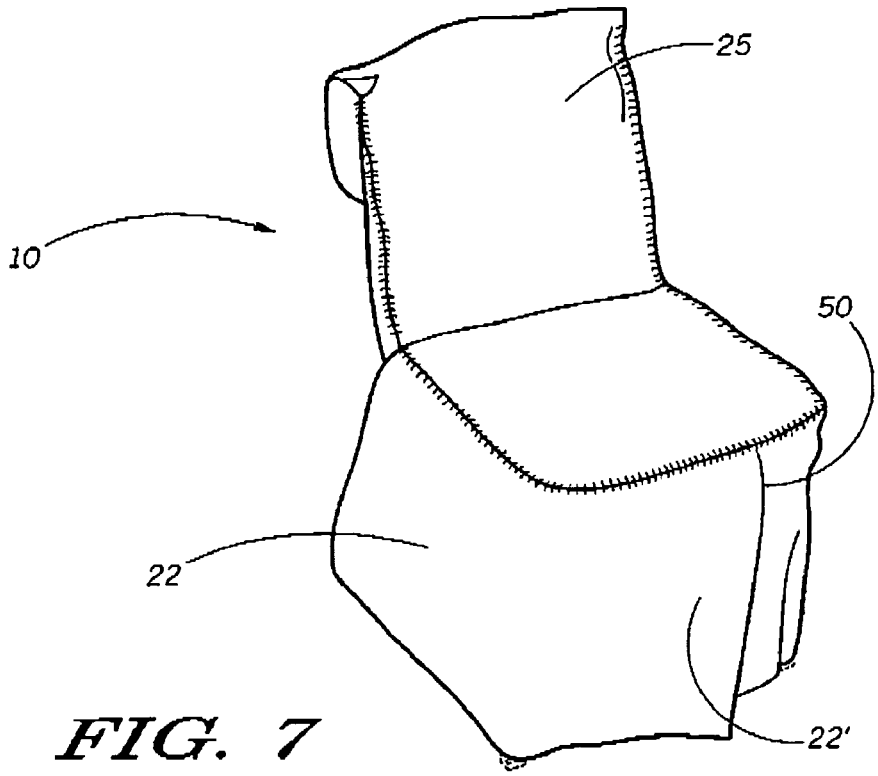
FIG. 7 is a front perspective view of the chair and cover shown in FIG. 6, without showing the banquet chair in phantom.
Figure 8:
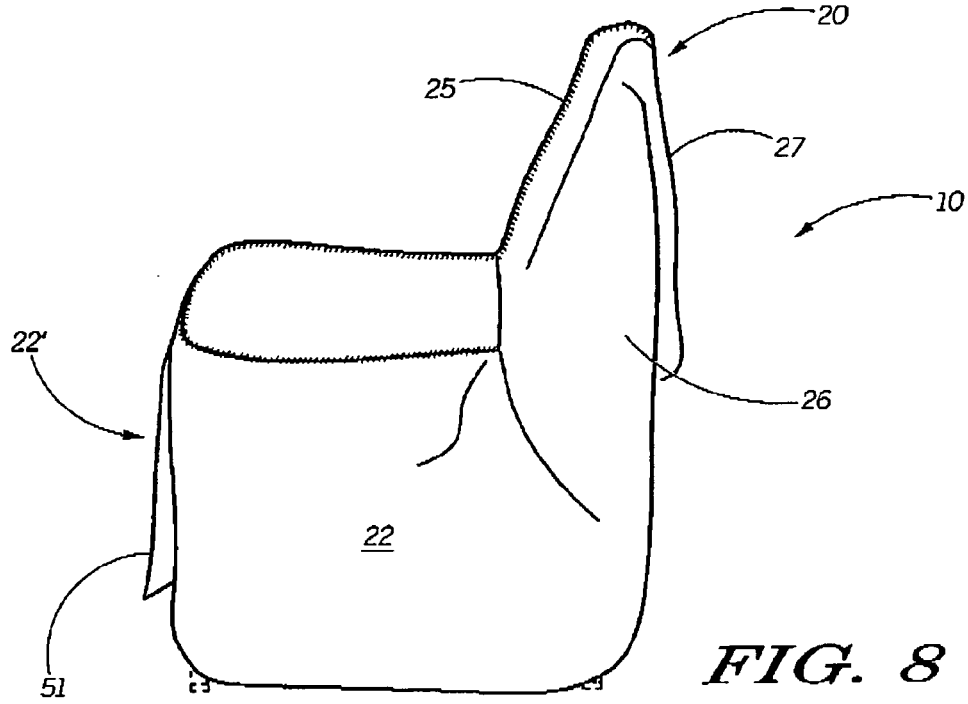
FIG. 8 is a right side elevational view of the chair and cover shown in FIGS. 6 and 7, without showing the banquet chair in phantom.
Figure 9:
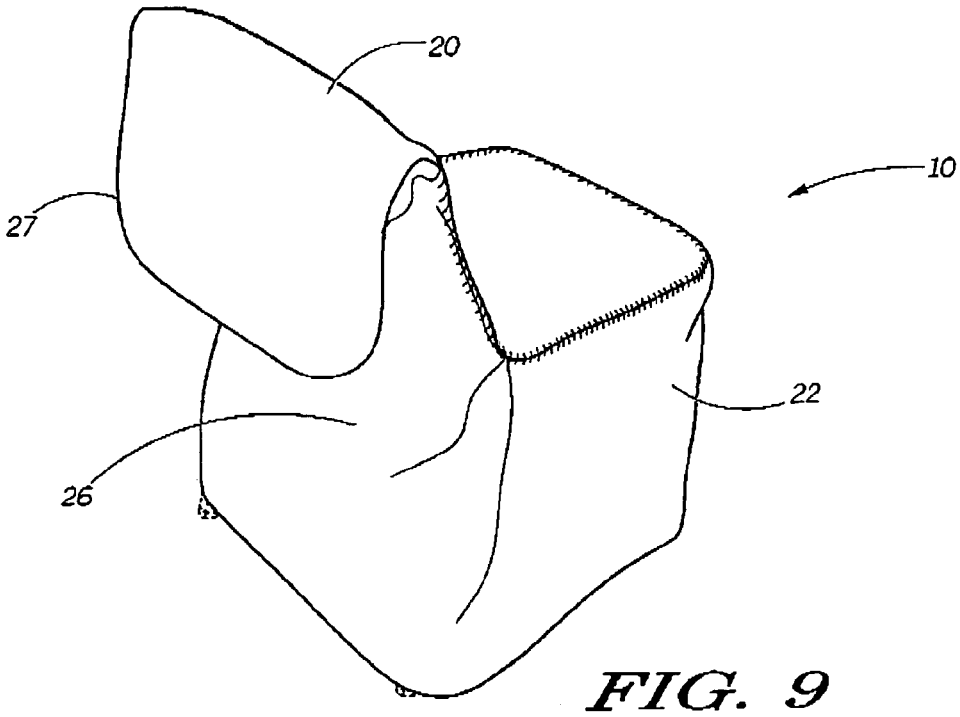
FIG. 9 is a rear perspective view of the assembled chair cover of the first embodiment in its final position about a banquet chair, without showing the banquet chair in phantom.

Still in the alternative, as best seen in FIGS. 6 and 7, a slit 50 may be provided in the front panel 22' of lower pocket 22. Slit 50 will accommodate a user's feet and legs if the user sitting in the chair attempts to tuck the user's legs up underneath the user. Slit 50 will alleviate undue tensile forces exerted on the material of cover 10 in the event of this occurring. Side edges "x" and "y" (shown in FIG. 2) form the respective edges of slit 50.

The particular dimensions of cover 10 are not critical to the present invention. Cover 10 may be produced in a variety of different sizes to accommodate chairs of different configurations and dimensions.

Panels 12, 14 of cover 10 may be of a substantially planar material formed from, for example, a suitable polymer or non-woven fiber material, both of which are widely used in the hygiene products industry, or a composite or laminate thereof. Suitable polymers include, by way of example, any material that can be formed into a film, including, but not limited to, polyolefins and polyacrylates, as well as co-polymers and blends thereof. Specific polymers include, but are not limited to, polyethylene, low density polyethylene, linear low density polyethylene and ethylene vinyl acetate.

The term "non woven" material fabric refers generally to materials having a structure of individual fibers or threads that are interlaid, not necessarily in a regular, repetitive manner as in a knitted fabric. Non-wovens provide cloth-like aesthetics at a lower cost than typical knitted fabrics. Non-woven fabrics or webs may be formed from many processes such as, for example, meltblowing processes, spunbonding processes, conforming processes, spunbonding/meltblowing/spunbonding processes and bonded carded web processes. These processes are all well known in the hygiene arts and non-woven materials are readily commercially available. For example, non-woven laminates have been available commercially for years from Kimberly Clarke Corporation.

Cover 10 may be substantially liquid impermeable, or may be liquid-permeable, depending upon the application to which the cover will be put. Alternatively, cover 10 may be made from a material that exhibits elastic properties, as such materials are known in the art. For example, U.S. Pat. No. 6,207,237 to Haffner discloses an elastic non-woven web or film manufactured from a thermo-plastic polymer. U.S. Pat. No. 6,096,668 discloses an elastic liquid impermeable laminate. U.S. Pat. No. 6,001,460 discloses a laminate material formed of an elastomeric polymer sheet and a non-woven fabric sheet. Other suitable elastic sheet materials are known to those skilled in the art.

Figure 10:
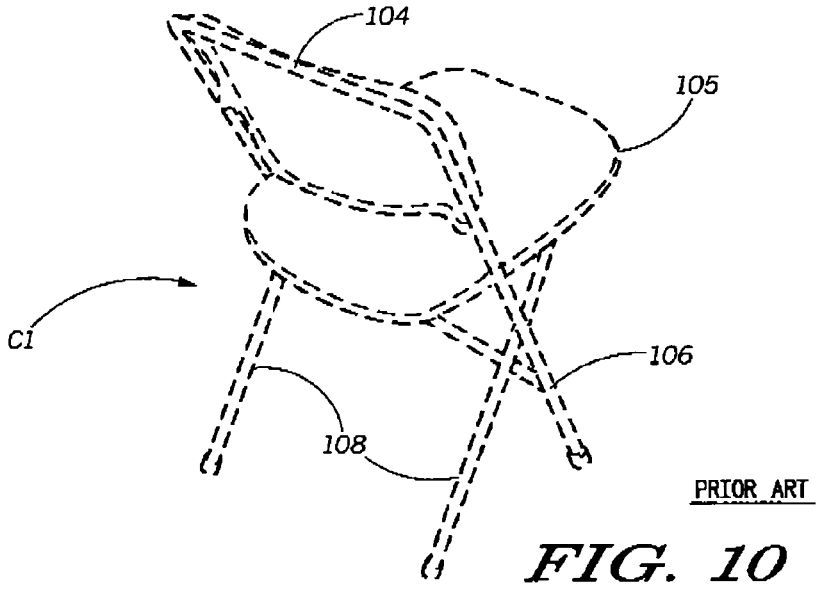
FIG. 10 shows a typical prior art folding chair which a second embodiment of the cover of the instant invention is meant to partially encapsulate.

FIG. 10 shows a conventional folding-type chair denoted by the letter "C1" of the type commonly used at social functions such as weddings, birthday parties, concerts, etc.

Figure 11:
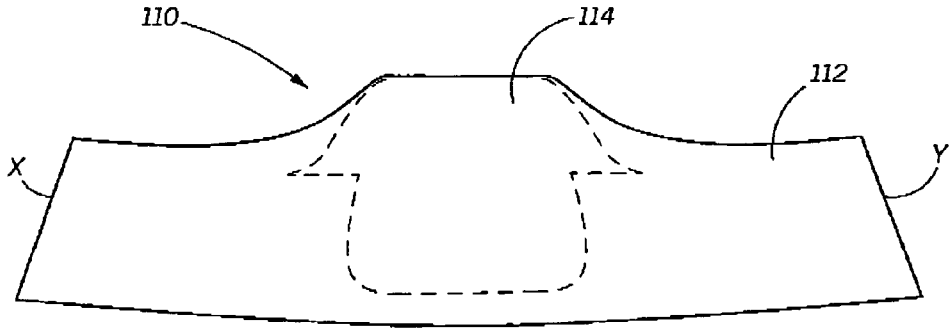
FIG. 11 is a plan view of two sections of non-woven fabric which are adapted to be sewn together or otherwise attached to form the second embodiment of the instant invention.
Figure 12:
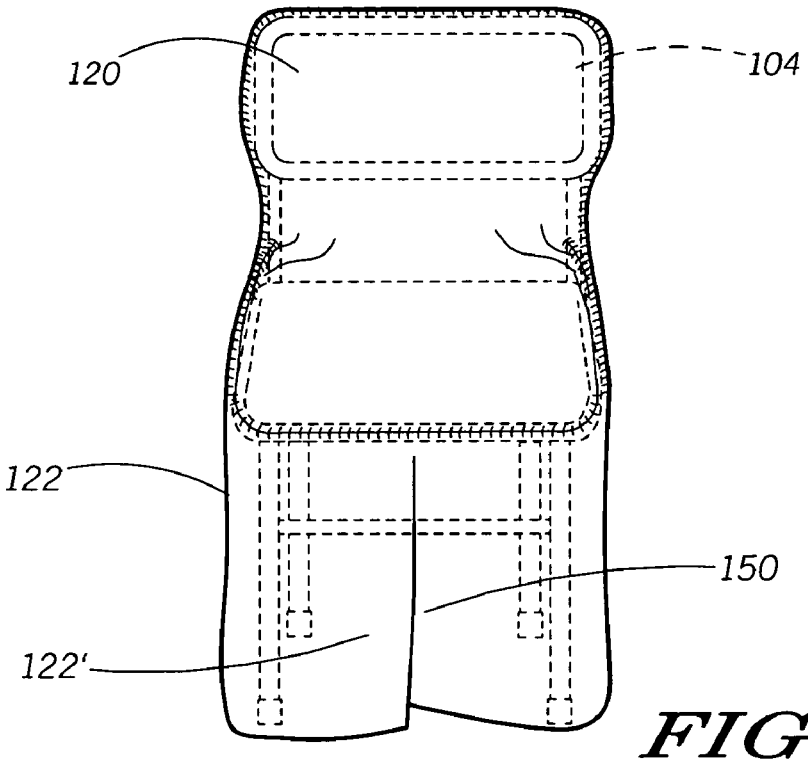
FIG. 12 is a front elevational view of the cover of the second embodiment of the invention in place about a folding chair.
Figure 13:
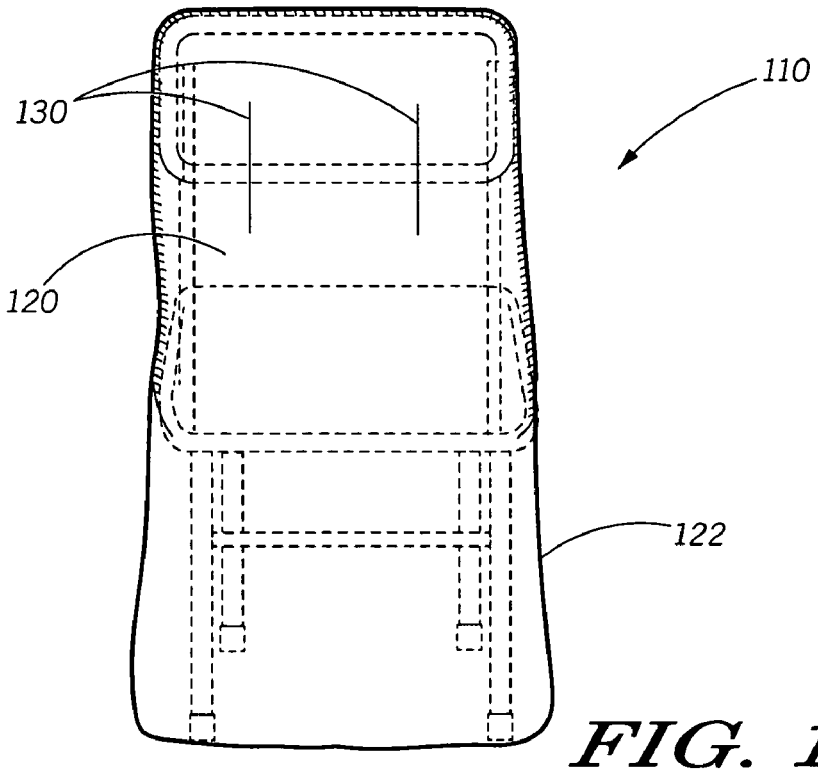
FIG. 13 is a rear elevational view of the cover of the second embodiment of invention placed about a folding chair.

FIG. 11 shows a typical pattern layout for a second embodiment of the non-woven fabric chair cover 110 of the instant invention adapted to be used to cover the folding-type chair shown in FIG. 10. The pattern layout for the cover 110 is shown in FIG. 11 prior to fabric sections 112, 114 being sewn or otherwise attached together to form a form-fitting chair cover 110. The material may be formed of two sheets 112, 114 which are to be sewn together in such a way as to form the cover shown in FIGS. 12 through 16. The panels 112, 114 may be attached through sewing/stitching, ultrasonic welding, adhesive, hook and loop fastener, snaps, buttons, or any other suitable connection structure. The cover 110, as seen in FIGS. 13 through 16, forms generally a back potion 120 adapted to at least partially envelope seat back section 104, as well as a lower chair cover 122 adapted to envelope seat portion 105 and front and rear legs 106, 108 of chair "C1". In this way, a user of the chair will not through ordinary use be able to come into contact with chair "C1" while cover 110 is in place.

FIGS. 12 through 16 show the chair cover after being assembled.

In front panel 122' of lower pocket 122, a slit 150 is employed as in the first embodiment to permit a user seated in the chair to tuck his or her legs up underneath the chair without tearing the cover 110.

Figure 14:
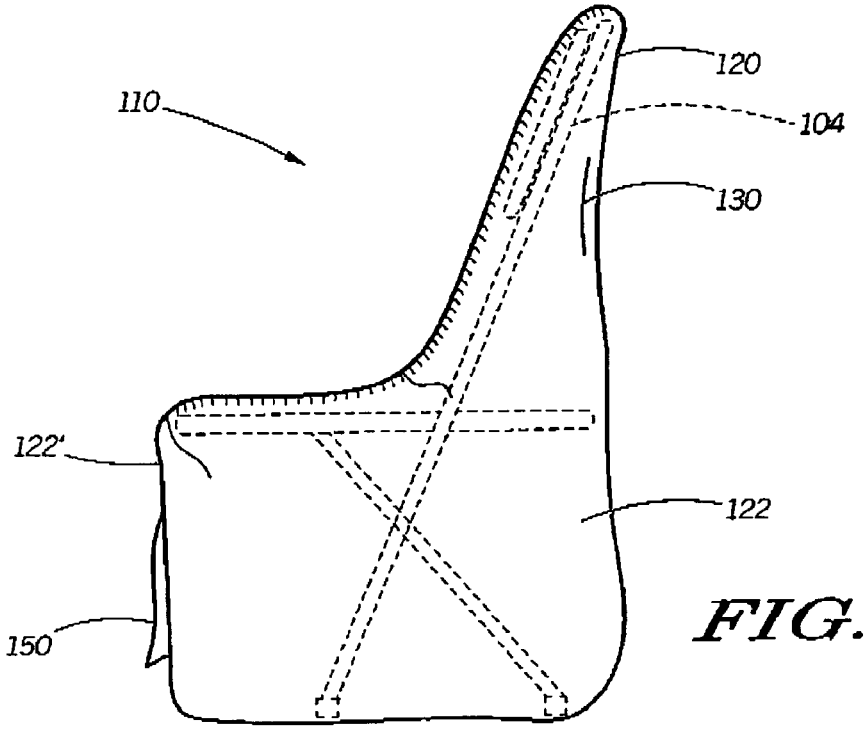
FIG. 14 is a right side elevational view of the cover of the second embodiment of the invention placed about a folding chair.
Figure 15:
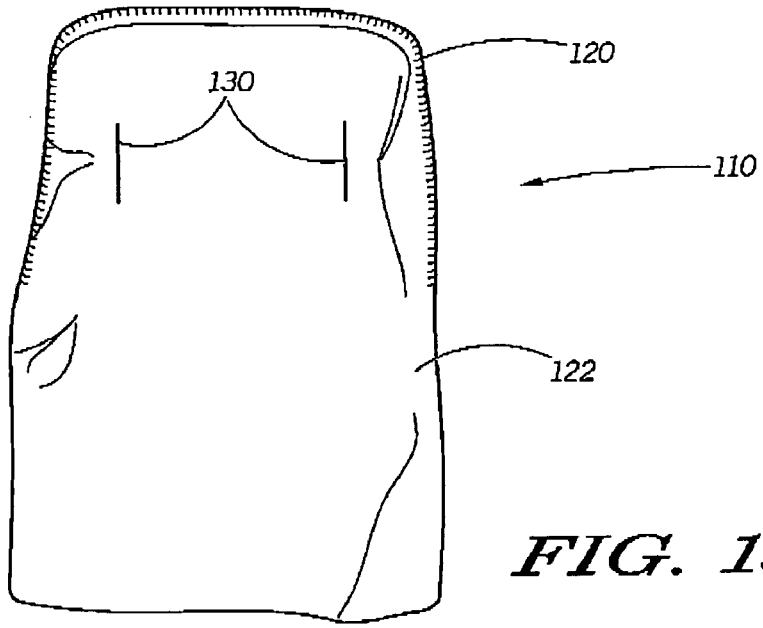
FIG. 15 is a rear elevational view of the cover of the second embodiment of this invention in place about a folding chair, without showing the folding chair in phantom.
Figure 16:
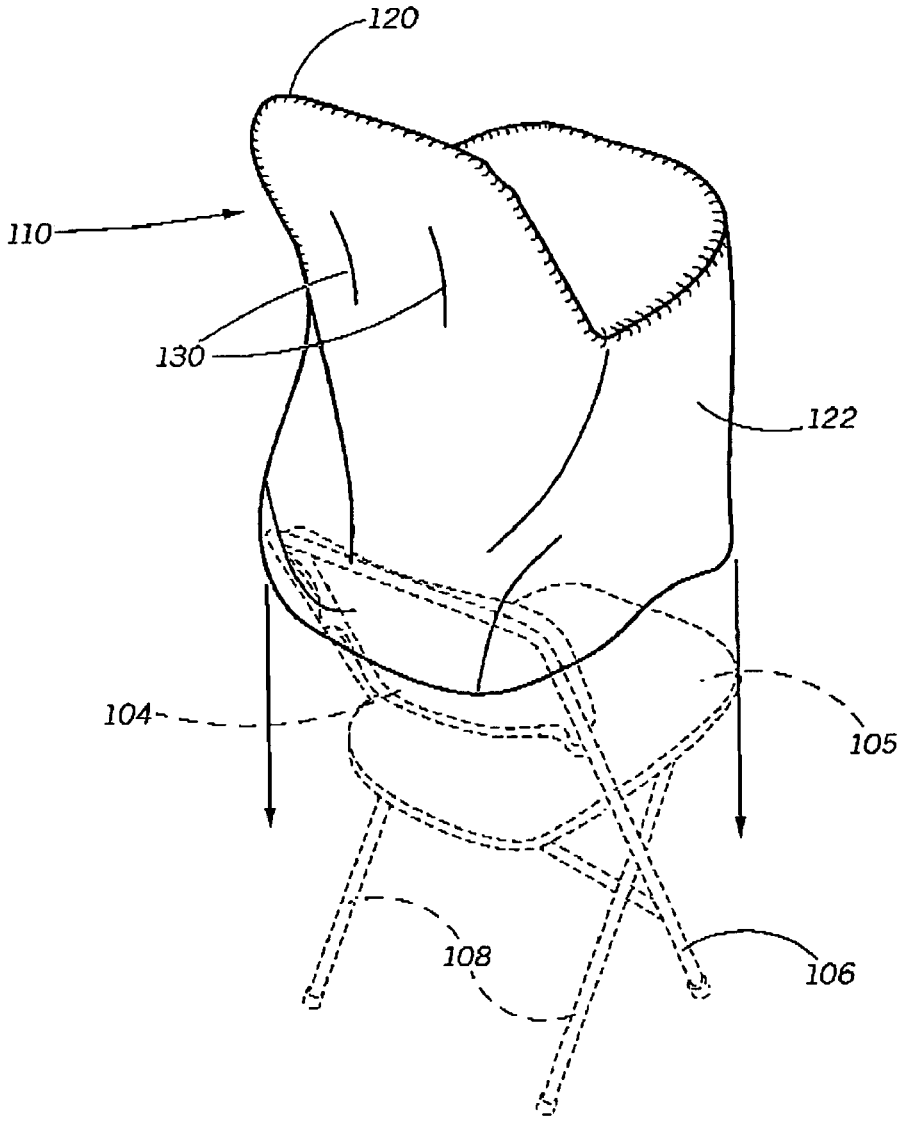
FIG. 16 is a rear perspective view of the cover of the second embodiment of this invention being placed about a folding chair.

As best seen in FIGS. 14 through 16, one or more pleats 130 or "tucks" may be employed to permit a certain amount of "give" in the upper pocket 120 so as to allow upper pocket 120 to fit snugly about the chair back 104.

It can be seen, therefore, that the covers 10 and 110 of the first and second embodiments of my invention fit easily and snugly about a standard folding-type chair to provide a protective cover for the chair as well as a beautiful ornamentation for an otherwise bland seating apparatus.

The invention has been shown and described herein in the form of a preferred embodiment with alternative features. It is to be understood, however, that I do not intend to limit the scope of my invention to the embodiment and additional features disclosed herein, and that my invention is intended to be limited only by the following claims.

What is claimed is:

1. A cover for a chair, the chair including legs, a seating portion and a seat back portion, comprising;

a sheet of polymeric non-woven fabric sized and shaped to be draped over a chair so as to cover to chair in form-fitting fashion, the sheet comprised of two sub-sheet sections attached to one another so as to permit the sheet to conform in shape to the chair, each sub-sheet section being one piece, wherein:

a first sub-sheet section being sized and shaped to generally surround substantially an entire length of the legs of the chair and to completely cover a top portion and sides of the seating portion of the chair, a second sub-sheet section covering a front facing side of the seat back portion, and ending in an adjustment flap which is adapted to be releasably attached to the first sub-sheet section at any one of a variety of adjustment positions to vary a vertical height of the chair cover relative to the chair, the adjustment flap having a first fastening structure associated therewith adapted to permit releasable fastening of the flap to the first sub-sheet section, and a second fastening structure associated with the first sub-sheet section adapted to releasably mate with the first fastening structure, the non-woven fabric being manufactured from one of the processes of melt-blowing, spunbonding, spunbonding/melt-blowing/spunbonding or bonded carded web, the non-woven fabric being comprised substantially exclusively of a series of interconnected polymer fibers.

2. A disposable, sanitary cover for a chair having a chair seat, legs and a chair back, comprising:

a first one-pieced sheet of non-woven material forming an enclosure for the chair seat and the chair legs, the first sheet covering entirely an upward facing surface and sides of the chair seat; and a second one-pieced sheet of non-woven material attached to the first sheet of non-woven material, the second sheet of non-woven material forming a chair back enclosure covering entirely a front facing side of the seat back, and ending in an adjustment flap which is adapted to be releasably attached to the first sheet at any one of a variety of adjustment positions to vary a vertical height of the chair cover relative to the chair, the adjustment flap having first fastening structure associated therewith adapted to permit releasable fastening of the flap to the first sheet, and second fastening structure associated with the first sheet adapted to releasably mate with the first fastening structure, the non-woven fabric being manufactured from one of the processes of meltblowing, spunbonding, spunbonding/melt-blowing/spunbonding or bonded carded web, the non-woven fabric being comprised substantially exclusively of a series of interconnected polymer fibers.

3. The cover of claim 2, further comprising an adjustment strip removably attached to the first sheet along a lower peripheral edge thereof.

* * * * *